US010822747B2

(12) United States Patent
Melvelle et al.

(10) Patent No.: US 10,822,747 B2
(45) Date of Patent: Nov. 3, 2020

(54) WORKHEAD FOR REMOVING A RAILWAY TRACK FASTENER

(71) Applicant: MELVELLE EQUIPMENT CORP. PTY LTD, New South Wales (AU)

(72) Inventors: Andrew Melvelle, New South Wales (AU); Ben de Rooy, New South Wales (AU); Gary Morris, New South Wales (AU)

(73) Assignee: Melvelle Equipment Corp. Pty Ltd, New South Wales (AU)

( * ) Notice: Subject to any disclaimer, the term of this patent is extended or adjusted under 35 U.S.C. 154(b) by 251 days.

(21) Appl. No.: 15/625,113

(22) Filed: Jun. 16, 2017

(65) Prior Publication Data

US 2018/0347120 A1 Dec. 6, 2018

(30) Foreign Application Priority Data

Jun. 6, 2017 (AU) ..... 2017203818

(51) Int. Cl.
*E01B 29/24* (2006.01)
*E01B 29/32* (2006.01)
*E01B 29/29* (2006.01)

(52) U.S. Cl.
CPC ..... *E01B 29/24* (2013.01); *E01B 29/29* (2013.01); *E01B 29/32* (2013.01)

(58) Field of Classification Search
CPC ..... E01B 29/24; E01B 29/32; B25D 1/02; B25D 17/08; B25D 17/084; B25D 17/005
USPC .... 29/252, 253, 426.5, 426.6, 275; 173/122, 173/205, 49, 29
See application file for complete search history.

(56) References Cited

U.S. PATENT DOCUMENTS 4,341,004 A * 7/1982 Echols ..... B25B 27/0042 29/275
2013/0319279 A1* 12/2013 Melvelle ..... E01B 29/24 104/2
2016/0084005 A1* 3/2016 Kuzma ..... B25D 16/00 173/1

FOREIGN PATENT DOCUMENTS

FR 2659674 A1 * 9/1991 ..... E01B 29/24
WO 2012083339 A1 6/2012

OTHER PUBLICATIONS

Title: "186EYE", Posting Date: Jun. 18, 2016, Site Name: Youtube.com, URL: https://www.youtube.com/watch?v=4yZ8FsKAnlg.

* cited by examiner

*Primary Examiner* — Orlando E Aviles
*Assistant Examiner* — Aaron R McConnell
(74) *Attorney, Agent, or Firm* — Levenfeld Pearlstein, LLC

(57) ABSTRACT

An apparatus is used to remove one of a plurality of railway track fasteners that secures a pair of laterally spaced railway tracks to underlying sleepers. The track fasteners are each in the form of a known e-clip or PR-clip fastener. The apparatus includes a support frame assembly adapted to locate on the railway tracks, a drive assembly mounted to the support frame assembly, and a workhead associated with the support frame assembly for removal of the track fastener. The workhead includes a percussion hammer and an associated hammer moil arranged for removal of the fastener. The hammer moil includes a moil mount connected at a predetermined angular offset to a moil head. The hammer moil is rotatable relative to the percussion hammer during removal of the track fastener whereby alignment between the moil head and the fastener is maintained.

20 Claims, 6 Drawing Sheets

WORKHEAD FOR REMOVING A RAILWAY TRACK FASTENER

TECHNICAL FIELD

The present invention relates broadly to a workhead for removing a railway track fastener and relates particularly, although not exclusively, to a hammer moil associated with the workhead for removing elastic rail clips.

BACKGROUND OF INVENTION

Railway track is usually fixed to the underlying supporting sleeper made of timber, concrete or steel using a variety of fasteners including traditional heavy gauge coach screws into timber sleepers, or sprung steel clips of various designs inserted under load into sleeper fittings or collars on both sides of each track. Railway track fastening technology often relies on the use of basic hand tools, particularly where corrosion or binding between track components results in difficulty in removing clips. In the harsh Australian environment and generally over time, clips become corroded and therefore difficult to remove as they disintegrate, lose flexibility or become 'welded' to the rail or sleeper through corrosion. Removal of clips in these situations can be difficult and dangerous due to the need to improvise using a rivet punch and sledge hammer to impact the offending clip in order to dislodge and remove it. Often these techniques result in occupational health and safety risks due to sprung steel clips becoming dangerous projectiles when freed suddenly. Improvisation in the removal or installation process, using heavy tools such as sledge hammers, also results in the possibility for operator injury.

Recently the emergence of specialised pneumatic or hydraulic equipment from a variety of international manufacturers has improved the safety, efficiency, and ease of clip insertion and removal. These machines are typically used by one or perhaps two operators, and usually consist of a chassis mounted and rolling on the track rail(s), and a workhead attached to the chassis and incorporating an insertion/removal mechanism. However, machines currently in the marketplace have several drawbacks:

1. They often do not sufficiently contain the clip during the insertion or removal operation and the energy from the deformed clip can transform it into a projectile and endanger the operator or surrounding crew;
2. The successful operation is dependent upon operator skill through alignment of the head with the clips; and
3. Particularly with heavily corroded clips, the operator must place a relatively high force to the machine to dislodge the clip.

The applicant set out to address these problems with their unique track clip remover which is the subject of patent protection in Australia and elsewhere, see PCT publication no. WO2012/083339. Although this clip remover is a significant advance on competing designs, it nonetheless struggles with the removal of heavily corroded or broken fasteners such as e-clip fasteners or other elastic rail clips.

SUMMARY OF INVENTION

According to a first aspect of the present invention there is provided an apparatus for removing a railway track fastener, said apparatus comprising:

a support frame assembly adapted to locate on one or both of a pair of laterally spaced railway tracks;

a drive assembly mounted to the support frame assembly, said drive assembly powered to activate a workhead associated with the support frame assembly for removal of the track fastener, the workhead including:

a) a percussion hammer;

b) a hammer moil including a moil mount coupled to and being in substantial alignment with the percussion hammer, said hammer moil including a moil head having a removal tool adapted to align for contact with the track fastener, the moil head connected at a predetermined angular offset to the moil mount whereby during removal of the track fastener the hammer moil rotates relative to the percussion hammer maintaining alignment between the removal tool and said fastener thereby at least in part compensating for the angular offset between the moil head and the moil mount.

Preferably the workhead also includes force biasing means designed to provide a biasing force to the track fastener whilst it is removed under the influence of the percussion hammer. More preferably the force biasing means includes one or more hydraulic or pneumatic cylinders coupled between the support frame assembly and the percussion hammer.

Preferably the support frame assembly includes a trolley arranged to locate on and span the pair of railway tracks, the trolley designed to assist with movement of the workhead between track fasteners to be removed. More preferably the support frame assembly also includes a boom assembly to which the drive assembly and the workhead are mounted at opposing respective ends. Even more preferably the boom assembly also includes a carriage pivotally mounted to the trolley for vertical movement of the workhead which is substantially counterbalanced by the drive assembly. Still more preferably the carriage is arranged to move across the trolley between the pair of railway tracks permitting removal of track fasteners from both tracks.

According to a second aspect of the invention there is provided a workhead for removing a railway track fastener, said workhead comprising:

a percussion hammer;

a hammer moil including a moil mount mounted to and being in substantial alignment with the percussion hammer, said hammer moil including a moil head having a removal tool adapted to align for contact with the track fastener, the moil head connected at a predetermined angular offset to the moil mount whereby during removal of the track fastener the hammer moil rotates relative to the percussion hammer maintaining alignment between the removal tool and said fastener thereby at least in part compensating for the angular offset between the moil head and the moil mount.

Preferably the percussion hammer is tilted at an angle relative to the track fastener to be removed, the tilt angle being sufficient to provide vertical clearance between the percussion hammer and a fastener adjacent the track fastener to be removed. More preferably the predetermined angular offset is dependent on the tilt angle of the percussion hammer.

Preferably the workhead also comprises a guide member arranged to assist with location of the removal tool for alignment with the track fastener prior to its removal from the associated railway track. More preferably the guide member is configured to restrain the track fastener on its removal.

According to a third aspect of the invention there is provided a hammer moil for removing a railway track fastener, said hammer moil comprising:

a moil mount adapted to mount to and being in substantial alignment with a percussion hammer;

a moil head connected at a predetermined angular offset to the moil mount, the moil head including a removal tool adapted to align for contact with the track fastener whereby during removal of the track fastener the hammer moil rotates relative to the percussion hammer maintaining alignment between the removal tool and said fastener thereby at least in part compensating for the angular offset between the moil head and the moil mount.

Preferably the moil head includes an eccentric lobe integral with and disposed at the predetermined angular offset to the moil mount. More preferably the eccentric lobe is configured to effect rotation of the hammer moil toward a neutral position when the removal tool is not in contact with the track fastener for its removal, said rotation toward the neutral position being in an opposite direction to the relative rotation of the hammer moil during removal of the track fastener.

Preferably the removal tool includes a tool mount detachably connected to the eccentric lobe, and a removal pin integral with the tool mount. More preferably the removal pin extends axially from, and is radially offset relative to, the tool mount to facilitate swinging of the removal pin for maintaining alignment with the track fastener during its removal. Still more preferably the removal pin is at least in part shaped complementary to and aligned with an engaged leg of the track fastener.

Preferably the moil mount includes a moil shaft located within a mating coupling of the percussion hammer. More preferably the mating coupling includes rotation biasing means arranged to cooperate with the moil shaft to, in conjunction with the eccentric lobe of the moil head, bias rotation of the hammer moil in one direction during removal of the track fastener. Even more preferably the hammer moil is biased for rotation in said one direction by swinging the eccentric lobe and the associated removal tool inward of the rail with which the track fastener is associated. Still more preferably the biasing means permits swinging of the eccentric lobe outward of the rail toward the neutral position when the removal tool is not in contact with the track fastener for its removal. Even still more preferably the moil shaft includes a bevelled section arranged to cooperate with the rotation biasing means in the form of a locking fastener arranged to abut the bevelled section when the hammer moil is at the neutral position to promote rotation of the hammer moil in the relative direction during removal of the track fastener. Alternatively the moil shaft is arranged for rotation in both directions without bias within the mating coupling of the percussion hammer.

Preferably the tool mount includes a mounting spigot configured to locate within a corresponding mounting cavity provided in the eccentric lobe for radial location of the removal tool. More preferably the tool mount also includes a body part shaped substantially complementary to fit within a corresponding recess formed in the eccentric lobe to restrict pivotal movement of the removal tool relative to the eccentric lobe. Even more preferably the removal tool includes a retaining pin arranged to releasably engage both the eccentric lobe and the tool mount for retention of the removal tool.

BRIEF DESCRIPTION OF DRAWINGS

In order to achieve a better understanding of the nature of the present invention a preferred embodiment of a workhead for removing a railway track fastener will now be described, by way of example only, with reference to the accompanying drawings in which.

DETAILED DESCRIPTION

Figure 1:
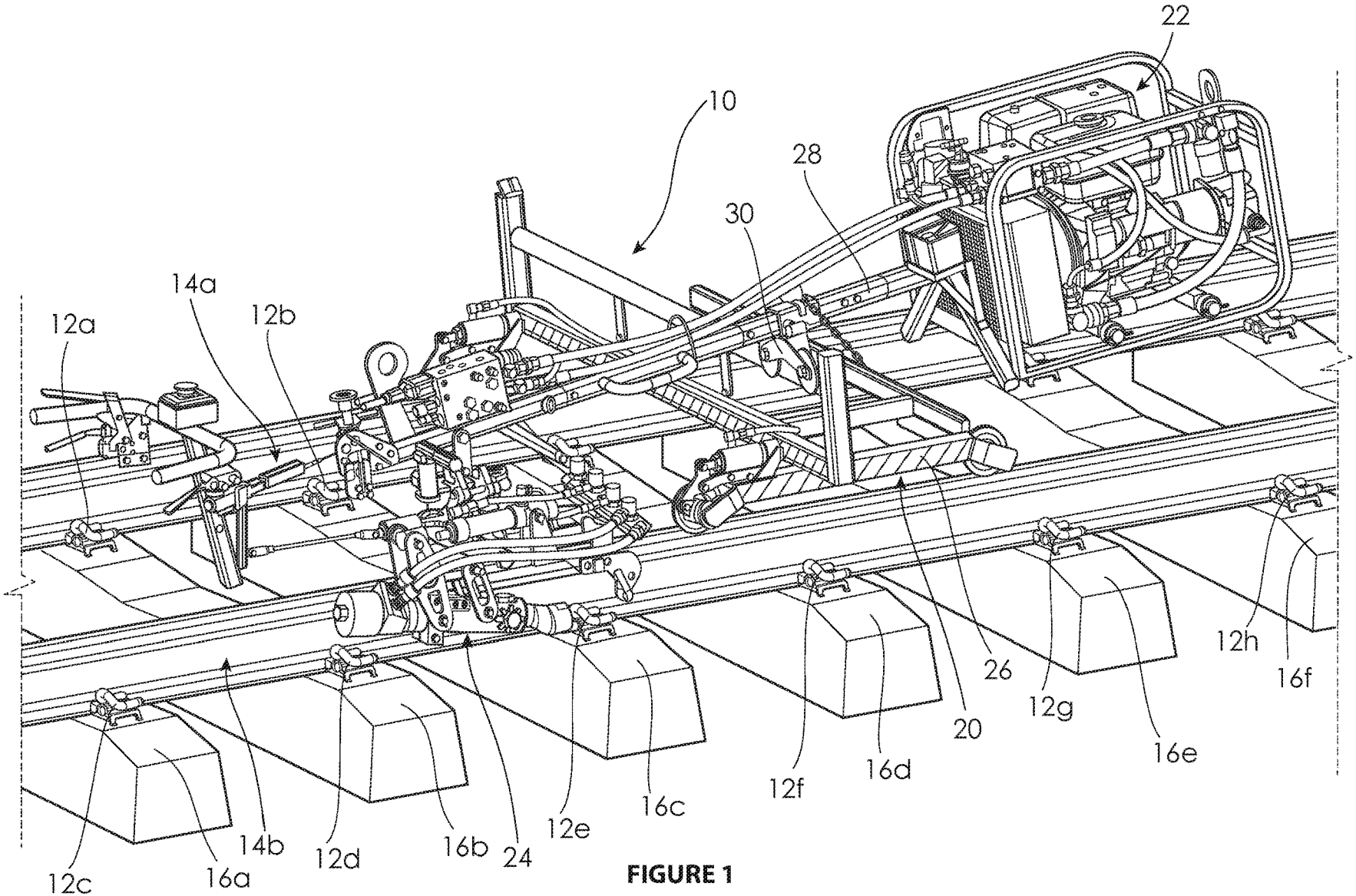
FIG. 1 is an overall assembly view of one embodiment an apparatus for removing a railway track fastener according to a first aspect of the invention.

As seen in FIG. 1 there is an apparatus 10 for removing one of a plurality of railway track fasteners such as 12*a* to 12*h* used to secure a pair of laterally spaced railway tracks 14*a* and 14*b* to underlying sleepers such as 16*a* to 16*f*. The track fasteners such as 12*e* are each in the form of an e-clip or PR-clip fastener of a known configuration having one leg 13*e* retained within an anchor member 15*e* associated with its corresponding sleeper 16*c* whilst an opposing leg is elastically deflected to exert a toe-load on the associated track 14*a* for its retention (see FIG. 4).

In this aspect the apparatus 10 comprises a support frame assembly 20 adapted to locate on the railway tracks 14*a/b*, a drive assembly 22 mounted to the support frame assembly 20, and a workhead 24 associated with the support frame assembly 20 for removal of the track fastener such as 12*a*. The drive assembly 22 is powered to activate the workhead 24 and the support frame assembly 20 includes a trolley 26 arranged to locate on and span the railway tracks 14*a/b*. The trolley 26 is designed to assist with movement of the workhead 24 between track fasteners such as 12*c* to 12*h* to be removed.

The support frame assembly 20 of this embodiment also includes a boom assembly 28 to which the drive assembly 22 and the workhead 24 are mounted at opposing respective ends. The boom assembly 28 includes a carriage 30 pivotally mounted to the trolley 26, the carriage 30 permitting:

1. vertical movement of the workhead 24 into general alignment with the track fastener such as 12*a* to be removed, the workhead 24 being substantially counter balanced by the drive assembly 22;
2. movement of the workhead 24 across the trolley 26 between the pair of railway tracks 14*a/b* for removal of track fasteners such as 12*a* or 12*d* from respective tracks 14*a* or 14*b*.

Figure 2:
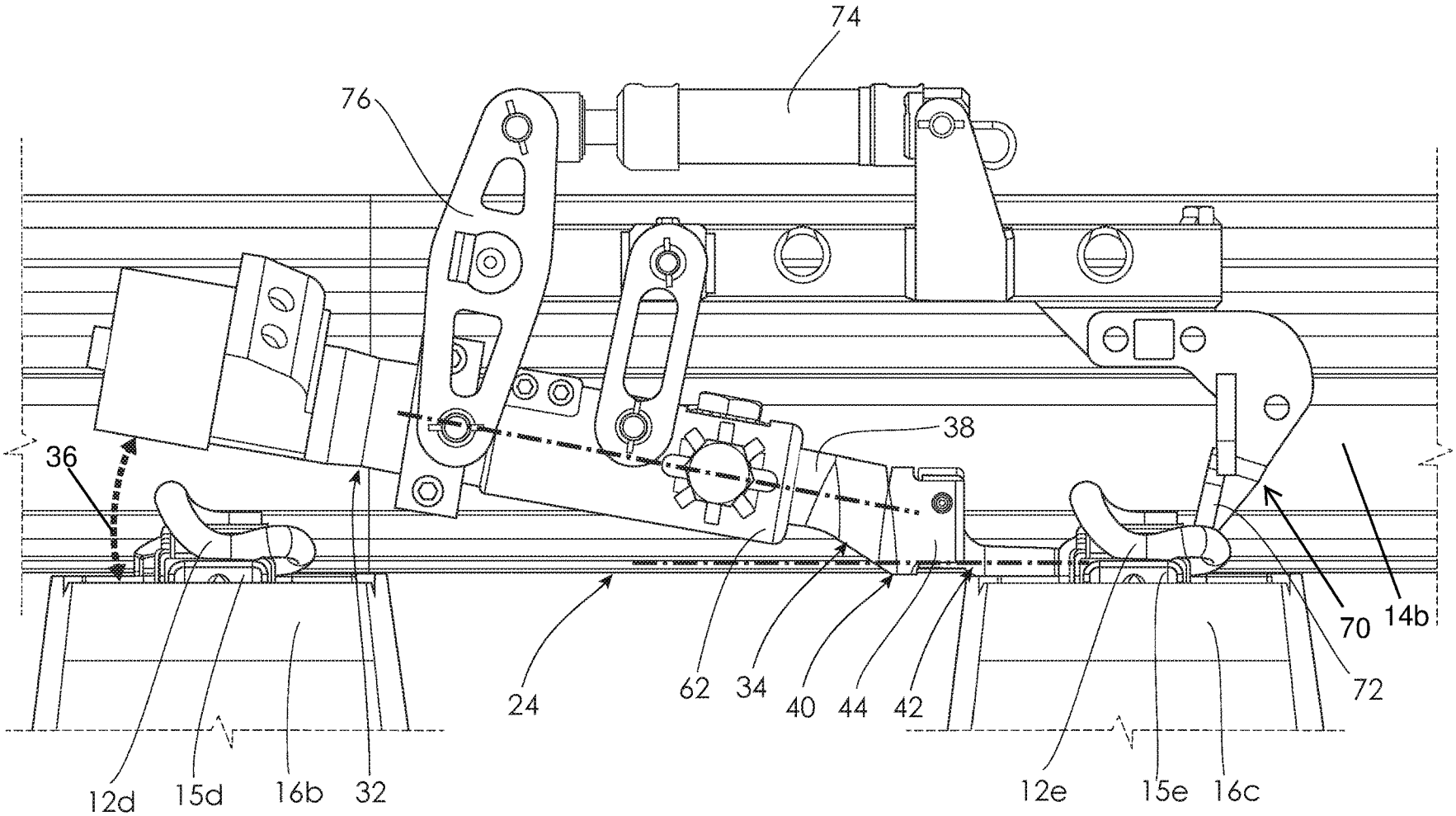
FIG. 2 is a side elevational view of a workhead taken from the apparatus of FIG. 1 depicting an embodiment of a second aspect of the invention.

FIG. 2 illustrates the workhead 24 taken from the apparatus 10 of the preceding aspect of the invention. The workhead 24 of this embodiment of this other aspect of the invention is shown in the course of removing the track fastener 12*e*. The workhead 24 comprises a percussion hammer 32 and an associated hammer moil 34 arranged for removal of the fastener 12*e*. The percussion hammer 32 is tilted at an angle 36 relative to the track fastener 12*e* to be removed. The tilt angle 36 is sufficient to provide vertical clearance between the percussion hammer 32 and the adjacent track fastener 12*d*.

Figure 3:
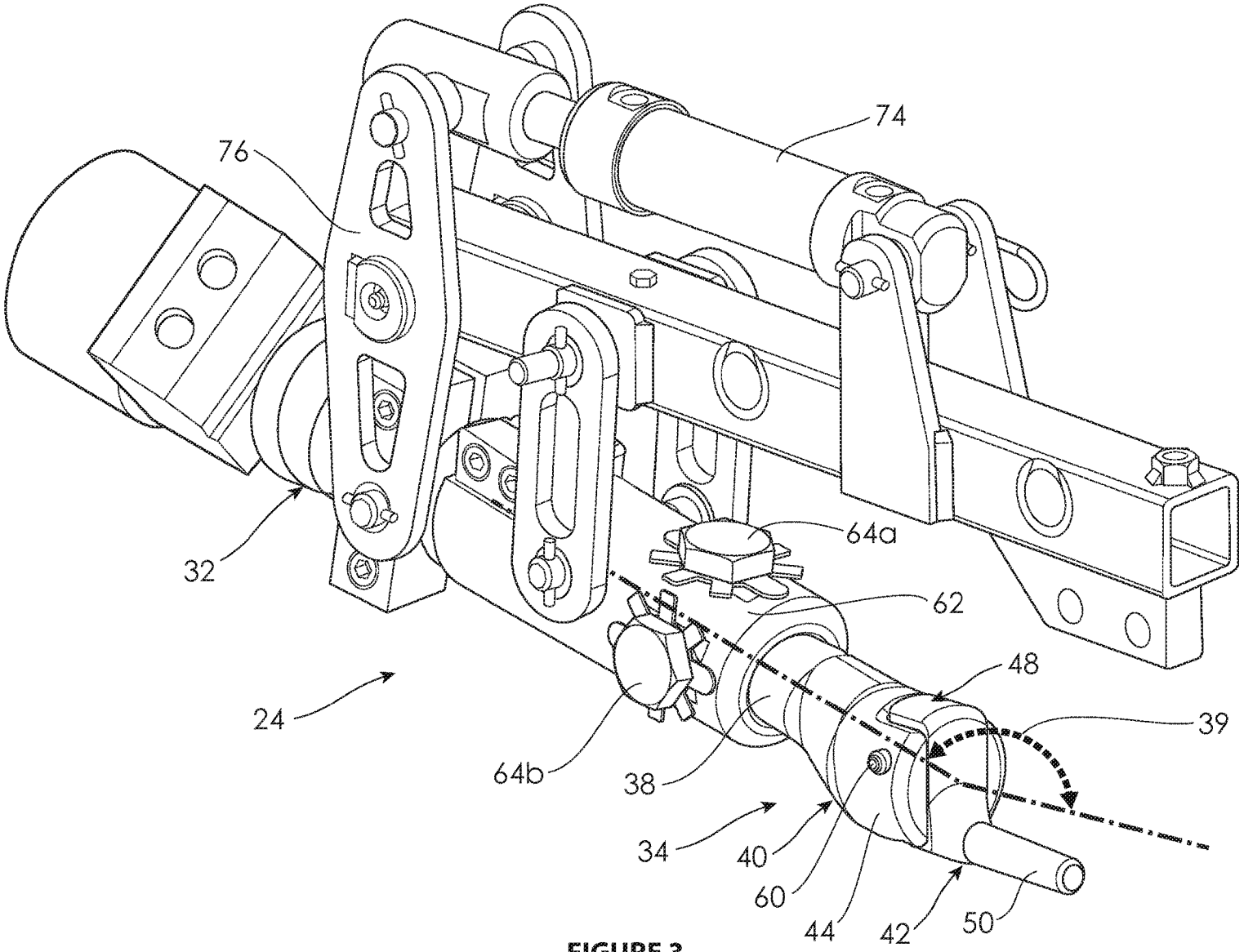
FIG. 3 is a perspective view of the workhead of FIG. 2.
Figure 4:
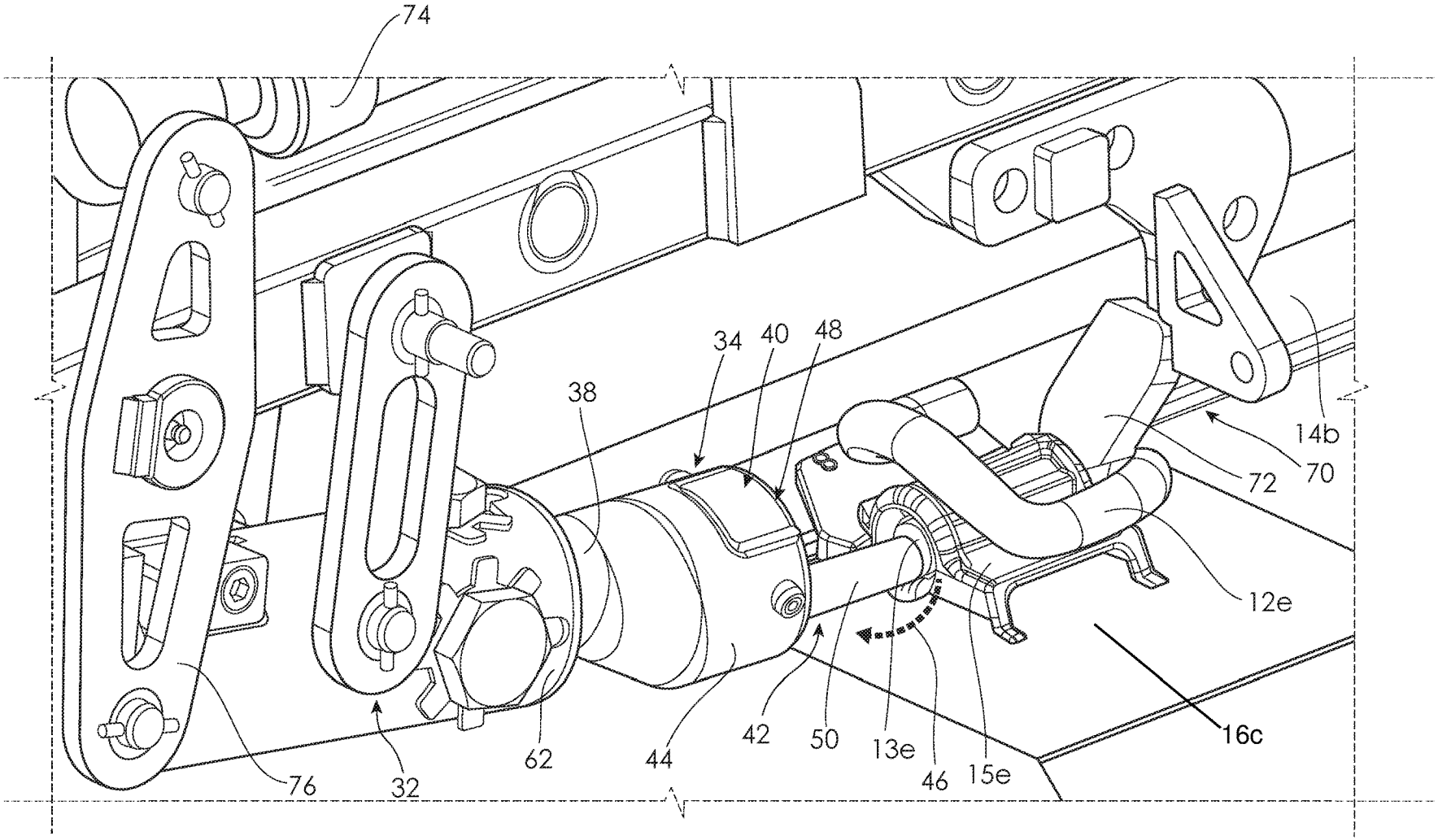
FIG. 4 is another perspective view of the workhead of FIG. 2 in conjunction with a railway track fastener to be removed.

FIGS. 3 and 4 further depict the workhead 24 of this aspect including the hammer moil 34 of an embodiment of a further aspect of the invention. The hammer moil 34 includes a moil mount 38 connected at a predetermined angular offset shown at 39 to a moil head 40. The moil mount 38 is coupled to and is in substantial alignment with the percussion hammer 32. The moil head 40 includes a removal tool 42 adapted to align for contact with the track fastener such as 12*a* in anticipation of its removal. The hammer moil 34 is rotatable relative to the percussion hammer 32 during removal of the track fastener such as 12*a* whereby alignment between the removal tool 42 and the fastener 12*a* is maintained. That is, the relative rotation of the hammer moil 34 at least in part compensates for the angular offset 39 between the moil head 40 and the moil mount 38. It will be understood that the predetermined angular offset 39 is to a large extent based or dependent on the tilt angle such as 36 at which the percussion hammer 32 is inclined relative to the fastener such as 12*a* to be removed.

In this embodiment the moil head 40 includes an eccentric lobe 44 integral with and disposed at the predetermined angular offset 39 to the moil mount 38. The eccentric lobe 44 is configured to allow rotation of the hammer moil 34 toward a neutral position when the removal tool 42 is not in contact with the track fastener such as 12*a* for its removal. As seen in FIG. 4, in the course of removing the track fastener such as 12*e* the hammer moil 34 rotates inward of the rail 14*b* in a clockwise direction as viewed at 46. This relative rotation of the hammer moil 34 assists in maintaining alignment between the removal tool 42 and the fastener such as 12*e*.

Figure 5:
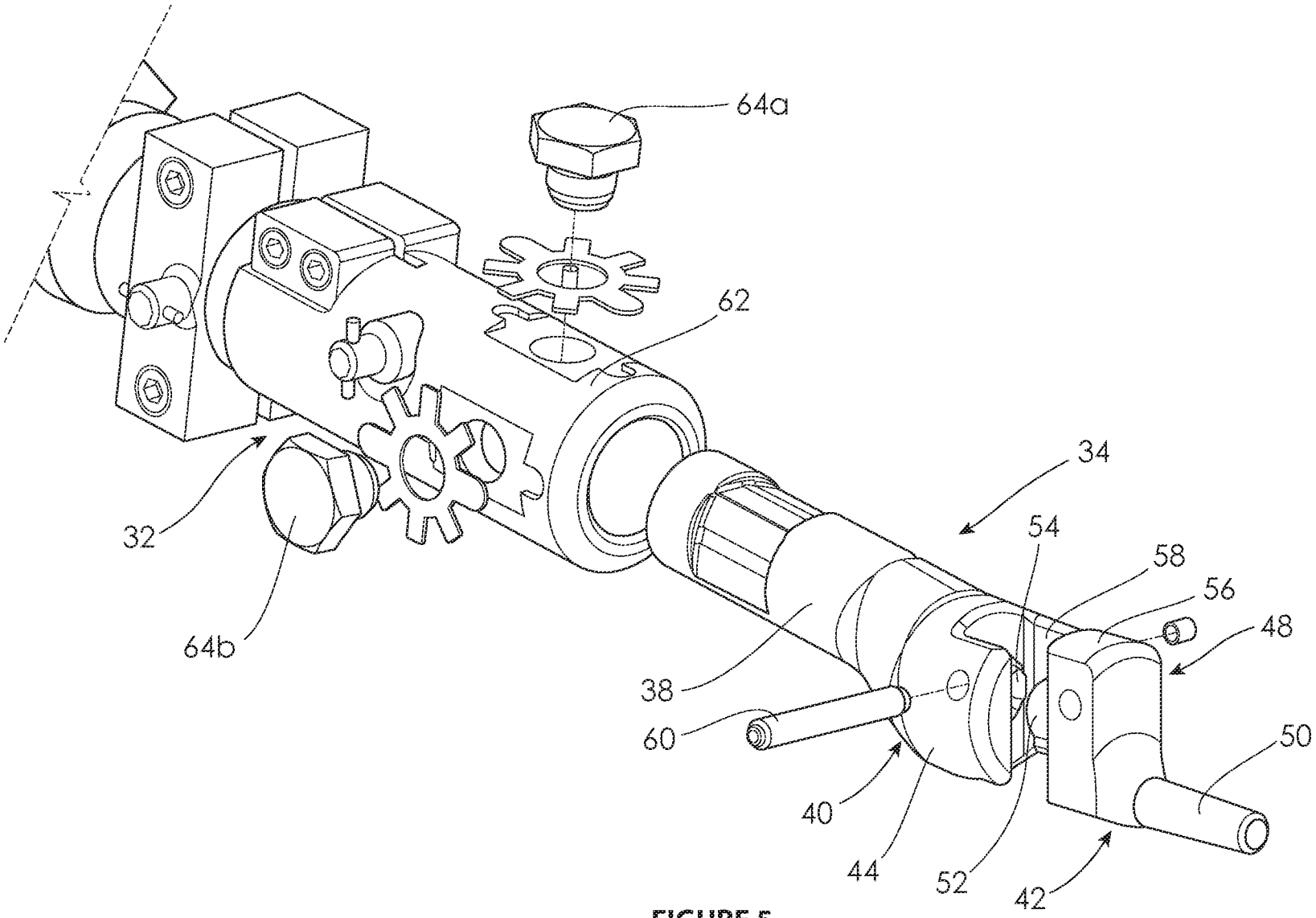
FIG. 5 is an exploded view of part of the workhead taken from FIGS. 2 to 4 illustrating a hammer moil according to an embodiment of a third aspect of the invention.

As best seen in FIG. 5 the removal tool 42 includes a tool mount 48 formed integral with a removal pin 50. The tool mount 48 is detachably connected to the eccentric lobe 44 so that as a wear part it can be easily replaced. The removal pin 50 extends axially from, and is radially offset relative to, the tool mount 48 to facilitate swinging of the removal pin 50 for maintaining alignment with the track fastener such as 12*e* during its removal. In this embodiment, the removal pin 50 is shaped substantially complementary to and aligned with the engaged leg 13*e* of the track fastener 12*e*.

The tool mount 48 of this embodiment includes a mounting spigot 52 configured to locate within a corresponding mounting cavity 54 provided in the eccentric lobe 44. The tool mount 48 also includes a body part 56 shaped substantially complementary to fit within a corresponding recess 58 formed in the eccentric lobe 44. The removal tool 42 thus relies upon the mounting spigot 52 and body part 56 in conjunction with the corresponding components of the eccentric lobe 44 for interlocking of these two parts. The removal tool 42 includes a retaining pin 60 arranged to releasably engage both the eccentric lobe 44 and the tool mount 48 for retention of the removal tool 42.

Figure 6:
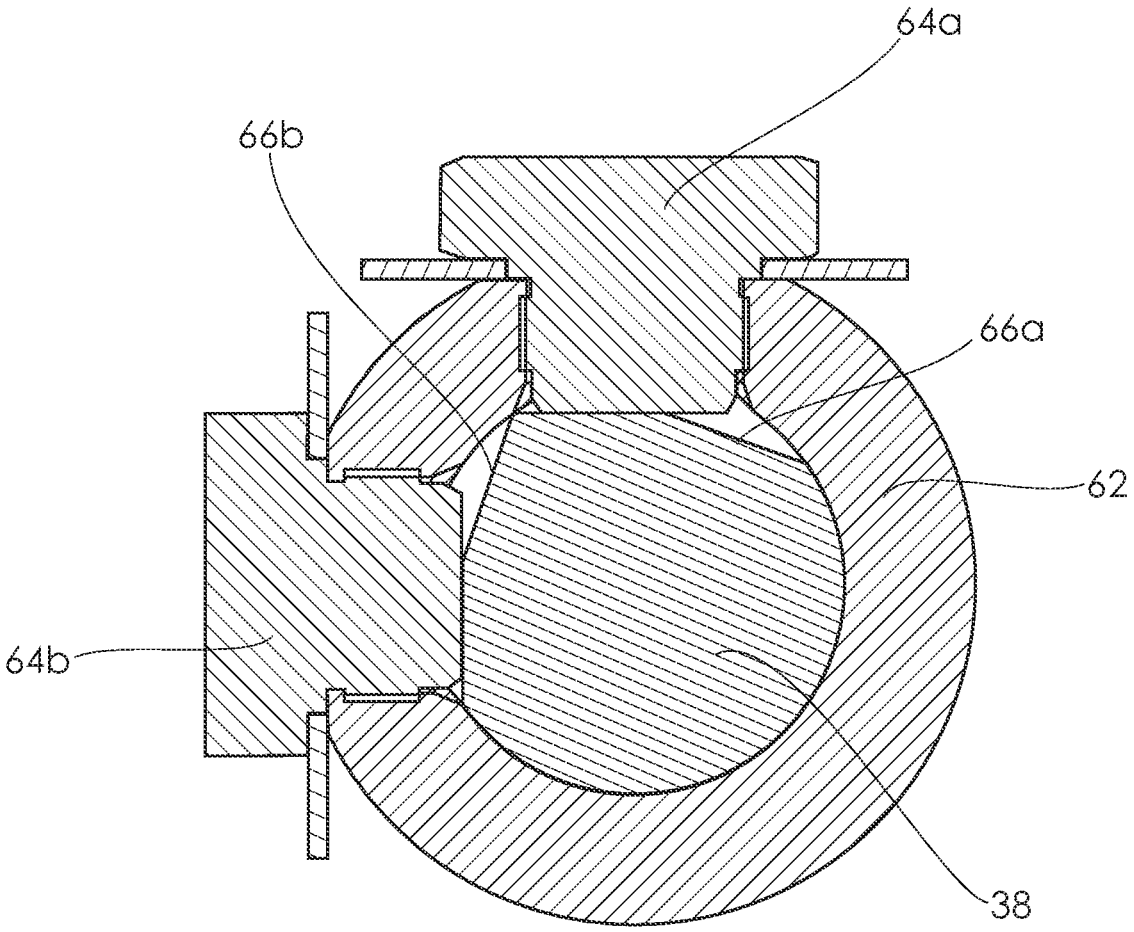
FIG. 6 is a cross section of part of the workhead including the hammer moil taken from FIGS. 2 to 4.

In this example the moil shaft 38 of the hammer moil 34 retractably locates within a mating coupling 62 of the percussion hammer 32. As best shown in FIG. 6 the mating coupling 62 includes rotation biasing means in the form of a pair of locking screws 64*a* and 64*b* arranged to cooperate with the moil shaft 38 to bias rotation of the hammer moil 34 in one direction only during removal of the track fastener such as 12*a*. In this instance the moil shaft 38 includes a pair of bevelled sections 66*a* and 66*b* arranged to cooperate with the respective locking screws 64*a* and 64*b* to:

1. abut the left hand face of the upper bevelled section 66*a* and lower face of the lower bevelled section 66*b* when the hammer moil 34 is at or close to the neutral position to promote its rotation in an anti-clockwise direction as seen in FIG. 6 during removal of the track fastener such as 12*a;*
2. limit rotation of the hammer moil 34 in the anti-clockwise direction as a consequence of abutment between the screw fasteners 64*a/b* and the right hand and upper faces respectively of the bevelled sections 66*a/b*.

It will be appreciated that the locking screws 64*a/b* also function to axially retain the hammer moil 34 within the mating coupling 62 of the percussion hammer 32. In an alternative embodiment rotation of the hammer moil 34 may be symmetric wherein the moil shaft 38 is shaped in cross-section to cooperate with one or more locking screws for rotation either side of the neutral position. In both embodiments, it will be appreciated that the relatively large eccentric lobe 44 under the influence of gravity returns the hammer moil 34 to its neutral position wherein the removal tool 42 or removal pin 50 realigns in anticipation of removing the next fastener.

Returning to FIG. 4, the workhead 24 also comprises a guide member 70 designed to assist with location of the removal tool 42 relative to the track fastener such as 12*e* prior to its removal. The guide member 70 is in the form of a bracket 72 opposing the removal pin 50 of the removal tool 42 with sufficient separation for a fastener such as 12*e* to be removed. The bracket 72 is designed to:

1. contact the anchor member 15*e*, within which the fastener 12*e* is engaged, for positive location of the workhead 24;
2. on removal of the fastener such as 12*e*, catch or restrain it for safety purposes;
3. react to hammer blows and biasing force associated with the percussion hammer 32.

The general steps involved in operating the apparatus 10 of the preceding embodiment as follows:

1. The trolley 26 is maneuvered along the railway tracks 12*a/b* so that the workhead 24 is generally in the vicinity of the fastener such as 12*e* to be removed;
2. The workhead 24 is lowered into close proximity to the fastener 12*e;*
3. The workhead 24 with the hammer moil 34 in the neutral position is urged into contact with an end face of the engaged leg 13*e* of the fastener such as 12*e;*
4. The drive assembly 22 is powered to activate the workhead 24 wherein:
   i. the percussion hammer 32 contacts the fastener 12*e* in a hammering action;
   ii. force biasing means coupled to the support frame assembly 20 provides a biasing force to the fastener 12*e* to promote its removal.

With the workhead 24 of FIGS. 2 to 4, the force biasing means includes a hydraulic or pneumatic cylinder 74 anchored at one end and connected at an opposite end to a fulcrum 76. The percussion hammer 32 is suspended from the fulcrum arm 76 wherein extension of the hydraulic or pneumatic cylinder 74 continues to apply pressure or the biasing force to the fastener 12*e* for its removal.

As seen in FIGS. 2 and 4 the tilt angle 36 of the percussion hammer 32 together with the angular offset 39 between the moil mount 38 and the moil head 40 combine to effect rotation of the hammer moil 34. This rotation allows for continued alignment of the removal tool 42 and in particular the removal pin 50 during removal of the fastener such as 12*e*. The removal tool 50 of this embodiment is maintained in guided alignment with the engaged leg 13*e* of the fastener 12*e* via the bore of the anchor member 15*e* from which it is removed. It will be appreciated that without rotation of the hammer moil 34, the removal tool 42 and in particular removal pin 50 will not automatically maintain alignment with the engaged leg 13*e* of the fastener 12*e*. This may result in failing of the removal tool 42 within the anchor member 15*e* and more generally lacks the extraction efficiency of the preferred embodiment where aligned contact is made between the removal tool 42 or pin 50 and the engaged leg 13*e* of the fastener 12*e*.

Now that a preferred embodiment of the invention in its various aspects has been described it will be understood that the workhead and associated hammer moil for removing railway track fasteners have at least the following advantages:

1. The workhead can be located for removal of a track fastener without obstruction from an adjacent fastener;
2. The hammer moil rotates relative to its associated percussion hammer ensuring continued alignment between the removal tool and track fastener for quick and efficient extraction of fasteners;
3. The hammer moil in one form includes the removal tool as a separate and replaceable wear part;
4. The workhead in conjunction with the associated drive assembly can be operated safely for effective removal of the fasteners and particularly those fasteners being heavily corroded or broken and typically difficult to extract.

Those skilled in the art will appreciate that the invention described herein is susceptible to variations and modifications other than those specifically described. For example, the support frame and drive assembly may vary from that described provided the workhead includes the core features disclosed in this specification. The hammer moil is preferably associated with the percussion hammer of the preferred embodiment but may alternatively be activated by other means which promotes removal of the railway track fastener. All such variations and modifications are to be considered within the scope of the present invention the nature of which is to be determined from the foregoing description.

The invention claimed is:

1. An apparatus for removing a railway track fastener, said apparatus comprising: a support frame assembly adapted to locate on one or both of a pair of laterally spaced railway tracks; a hydraulic drive assembly mounted to the support frame assembly, said hydraulic drive assembly powered to activate a workhead associated with the support frame assembly for removal of the track fastener, the workhead including: al a percussion hammer; and b} a hammer moil being rotatable relative to the percussion hammer, said hammer moil including a moil mount located within and being in alignment with a mating coupling of the percussion hammer, said hammer moil including a moil head having a removal tool adapted to align for contact with the track fastener, the moil head connected at a predetermined angular offset to the moil mount whereby during removal of the track fastener the moil mount of the hammer moil rotates within the mating coupling of the percussion hammer maintaining alignment between the removal tool and said fastener thereby at least in part compensating for the angular offset between the moil head and the moil mount.

2. The apparatus as claimed in claim 1 wherein the workhead also includes one or more hydraulic cylinders coupled between the support frame assembly and the percussion hammer designed to provide a biasing force to the track fastener whilst the track fastener is removed under the influence of the percussion hammer.

3. A workhead for removing a railway track fastener, said workhead comprising:

a percussion hammer; and a hammer moil being rotatable relative to the percussion hammer, said hammer moil including a moil mount located within and being in alignment with a mating coupling of the percussion hammer, said hammer moil including a moil head having a removal tool adapted to align for contact with the track fastener, the moil head connected at a predetermined angular offset to the moil mount whereby during removal of the track fastener the moil mount of the hammer moil rotates within the mating coupling of to the percussion hammer maintaining alignment between the removal tool and said fastener thereby at least in part compensating for the angular offset between the moil head and the moil mount.

4. The workhead as claimed in claim 3 wherein the percussion hammer is tilted at an angle relative to the track fastener to be removed, the tilt angle being sufficient to provide vertical clearance between the percussion hammer and a fastener adjacent the track fastener to be removed.

5. The workhead as claimed in claim 4 wherein the predetermined angular offset is dependent on the tilt angle of the percussion hammer.

6. The workhead as claimed in claim 3 wherein the moil head includes an eccentric lobe integral with and disposed at the predetermined angular offset to the moil mount.

7. The workhead as claimed in claim 6 wherein the eccentric lobe is configured to effect rotation of the hammer moil toward a neutral position when the removal tool is not in contact with the track fastener for the track fastener's removal, said rotation toward the neutral position being in an opposite direction to the relative rotation of the hammer moil during removal of the track fastener.

8. The workhead as claimed in claim 6 wherein the removal tool includes a tool mount detachably connected to the eccentric lobe, and a removal pin integral with the tool mount.

9. The workhead as claimed in claim 8 wherein the removal pin extends axially from, and is radially offset relative to, the tool mount to facilitate swinging of the removal pin for maintaining alignment with the track fastener during the track fastener's removal.

10. The workhead as claimed in claim 8 wherein the removal pin is at least in part shaped complementary to and aligned with an engaged leg of the track fastener.

11. The workhead as claimed in claim 6 wherein the moil mount includes a moil shaft located within the mating coupling of the percussion hammer.

12. The workhead as claimed in claim 11 wherein the mating coupling includes a rotation biasing mechanism arranged to cooperate with the moil shaft to, in conjunction with the eccentric lobe of the moil head, bias rotation of the hammer moil in one direction during removal of the track fastener.

13. A hammer moil for removing a railway track fastener, said hammer moil comprising:

a moil mount being rotatable relative to a percussion hammer, said moil mount located within and being in alignment with a mating coupling of the percussion hammer; and a moil head connected at a predetermined angular offset to the moil mount, the moil head including a removal tool adapted to align for contact with the track fastener whereby during removal of the track fastener the moil mount of the hammer moil rotates within the mating coupling of the percussion hammer maintaining alignment between the removal tool and said fastener thereby at least in part compensating for the angular offset between the moil head and the moil mount.

14. The hammer moil as claimed in claim 13 wherein the moil head includes an eccentric lobe integral with and disposed at the predetermined angular offset to the moil mount.

15. The hammer moil has claimed in claim 14 wherein the eccentric lobe is configured to effect rotation of the hammer moil toward a neutral position when the removal tool is not in contact with the track fastener for the track fasteners removal, said rotation toward the neutral position being in an opposite direction to the relative rotation of the hammer moil during removal of the track fastener.

16. The hammer moil as claimed in claim 14 wherein the removal tool includes a tool mount detachably connected to the eccentric lobe, and a removal pin integral with the tool mount.

17. The hammer moil as claimed in claim 16 wherein the removal pin extends axially from, and is radially offset relative to, the tool mount to facilitate swinging of the removal pin for maintaining alignment with the track fastener during the track fastener's removal.

18. The hammer moil as claimed in claim 16 wherein the removal pin is at least in part shaped complementary to and aligned with an engaged leg of the track fastener.

19. The hammer moil as claimed in claim 14 wherein the moil mount includes a moil shaft located within the mating coupling of the percussion hammer.

20. The hammer moil as claimed in claim 19 wherein the mating coupling includes a rotation biasing mechanism arranged to cooperate with the moil shaft to, in conjunction with the eccentric lobe of the moil head, bias rotation of the hammer moil in one direction during removal of the track fastener.

* * * * *